US005406923A

United States Patent [19]

Fehlmann et al.

[11] Patent Number: 5,406,923

[45] Date of Patent: Apr. 18, 1995

[54] FUEL INJECTION PUMP

[75] Inventors: Wolfgang Fehlmann, Stuttgart; Gerold Schultheiss, Pforzheim, both of Germany

[73] Assignee: Robert Bosch GmbH, Stuttgart, Germany

[21] Appl. No.: 127,028

[22] Filed: Sep. 24, 1993

[30] Foreign Application Priority Data

Nov. 6, 1992 [DE] Germany ..... 42 37 471.5

[51] Int. Cl.[6] ..... F02M 37/04

[52] U.S. Cl. ..... 123/502; 123/449

[58] Field of Search ..... 123/502, 501, 500, 495, 123/503, 449, 450

[56] References Cited

U.S. PATENT DOCUMENTS

| | | | |
|---|---|---|---|
| 4,080,109 | 3/1978 | Green | 123/502 |
| 4,393,846 | 7/1983 | Mowbray | 123/502 |
| 4,407,250 | 10/1983 | Eheim | 123/450 |
| 4,448,774 | 5/1984 | Takahashi | 123/502 |
| 4,552,117 | 11/1985 | Djordjevic | 417/462 |
| 4,644,924 | 2/1987 | Djordjevic | 123/450 |
| 5,059,096 | 10/1991 | Harris | 417/462 |

FOREIGN PATENT DOCUMENTS

| | | | |
|---|---|---|---|
| 0012035 | 1/1979 | Japan | 123/502 |
| 0162325 | 9/1984 | Japan | 123/503 |
| 2118255 | 10/1983 | United Kingdom | 123/502 |

*Primary Examiner*—Carl S. Miller

*Attorney, Agent, or Firm*—Edwin E. Greigg; Ronald E. Greigg

[57] ABSTRACT

A cam ring for a cam drive of a distributor radial piston injection pump. Said cam ring includes on the outside a connecting member which is formed in one piece that is particularly roller-shaped with an axis parallel to the axis of the cam ring and that engages a recess of an adjusting member that serves in the adjustment of the cam ring. This results in an embodiment of the cam drive that can be advantageously assembled and has a well-designed cam ring with a very low incidence of failure with regard to durability, production and assembly.

6 Claims, 1 Drawing Sheet

Fig.1
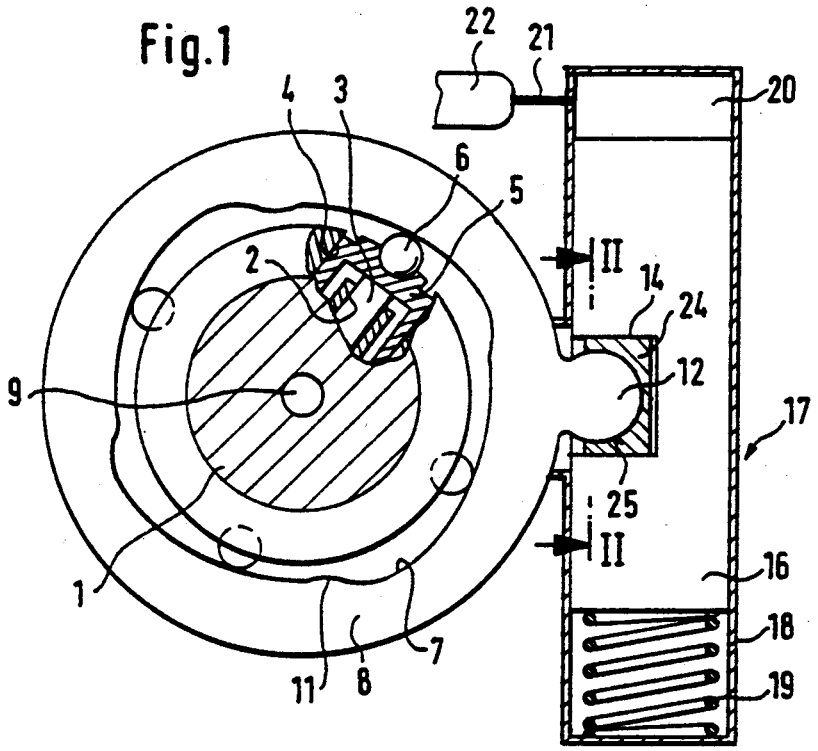
Fig. 2
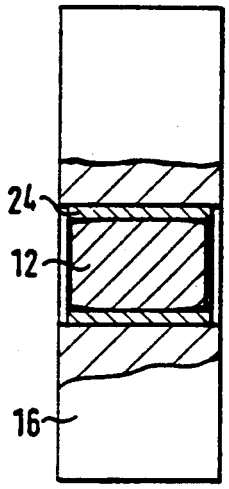
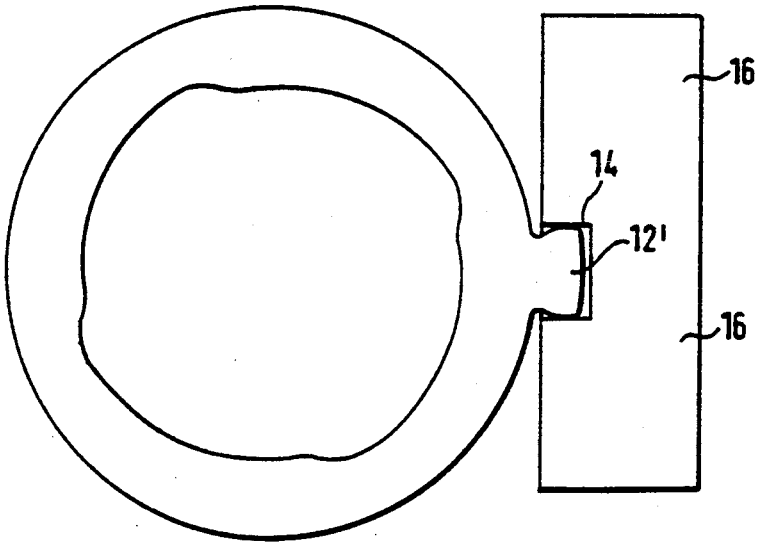
Fig. 3

FUEL INJECTION PUMP

BACKGROUND OF THE INVENTION

The invention is directed to improvements in fuel injection pumps for internal combustion engines.

A fuel injection pump of this type that is known from European Patent Publication EP-A-0039304 is designed in the manner of a distributor injection pump, in that radially disposed pump pistons are provided in a rotatingly driven distributor that are supported via roller shoes on a cam race disposed on an annular element that is essentially stationarily or rotatably seated in the pump housing. By means of the inwardly pointing cams, the pump pistons experience a back-and-forth motion, whereby intake and pumping cycles alternate, and fuel is thus supplied at high pressure to one of a plurality of individual injection lines, depending on the positions of the distributor. To adjust the point in time during which a respective high-pressure pumping cycle begins, the cam ring is rotatably disposed. For this purpose, it has a radially screwed-in connecting element whose outer end is a ball end, with which it engages an adjusting piston of an injection timing mechanism. In the process the adjusting piston is displaced by a hydraulic control fluid counter to the force of a restoring spring, and thus changes the position of rotation of the cam ring and therefore the beginning of high-pressure pumping of the pump piston or the start of fuel injection.

In the known embodiment the connecting member is therefore screwed into a tapped bore disposed in a radial cam ring. Such a bore is disadvantageous for a very high-stressed part like the cam ring, which must be hardened to have the required wear-resistance in operation on the one hand, yet because of this hardening is extremely notch-sensitive on the other. Added to this are the costs of cutting the tapped bore and the screw connection of the connecting member.

OBJECTS AND SUMMARY OF THE INVENTION

In contrast, it is the principal object of the fuel injection pump of the invention to provide the advantage that a significantly better introduction of the adjusting force to be exerted on the cam ring is possible with the formed-on connecting member, and this also applies for the retaining force in a specific setting of the cam ring counter to the rotational forces occurring by means of the running of the rollers on the cam during the pumping cycle of the pump pistons. Furthermore, the connecting member can now be placed on the inside of the cam ring independently of the position of the cams, because the cam ring wall thickness is no longer affected, as is the case with the prior art. The assembly of the cam ring in connection with the adjusting member is also simplified, because the relatively small connecting member need not be screwed in separately during assembly.

It is an advantageous further object of the invention that the connecting member can also be roller-shaped with an axis that is parallel to the axis of the cam ring; the advantage of this is that a larger force transfer cross-section is available at the point of transfer of the connecting element to the cam ring.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a first exemplary embodiment in an overhead view of the annular element, the cam ring in a first embodiment;

FIG. 2 shows a section perpendicular to the plane of the illustration of FIG. 1 as a top view of the adjusting element of the cam ring; and FIG. 3 shows a second exemplary embodiment with a modified connecting member.

DESCRIPTION OF THE PREFERRED EMBODIMENTS

FIG. 1 shows a cam drive of a fuel injection pump of the distributor pump design in partial section through the injection pump; this cam drive acts to generate the motion of the pump pistons of the fuel injection pump that are not shown in more detail. This injection pump is designed in the manner of a distributor radial pump piston, as is shown by the section through a distributor 1 in FIG. 1. This distributor is rotatingly driven by a motor shaft that is not shown in more detail, and has radial bores 2, which, as pump cylinders, guide pump pistons 3. Moreover, one roller tappet 5 is respectively guided, together with a roller 6 that runs on a cam race 7 of a cam ring 8 during rotation of the distributor 1, in a bore 4 connecting radially outwardly to the bores 2 and having a larger diameter. In the process the pump pistons define a pump work chamber (not shown) connected to the shaft of the distributor and leading to the distribution point of the distributor, which is not shown, via an axial pressure bore 9. Depending on the rotational position of the distributor, one of a plurality of outgoing injection lines distributed around the circumference of the distributor lead off from there. These supply corresponding injection valves.

In the illustrated embodiment, four uniformly distributed pump pistons that feed together toward the pressure bore 9 are provided in the distributor. Correspondingly, inwardly pointing cams 11 are provided on the cam race 4. The cam race is located on a ring with an essentially square cross-section. While it is sufficient that the cam ring remains still for conveying fuel and driving the pump piston, wherein it is guided in a corresponding, cylindrical receptacle of the pump housing, which is not shown in further detail, it is rotated by the adjustment of the beginning of pumping of the pump piston. Thus, depending on the rotational position of the cam ring, a pressure stroke of the pump pistons is effected earlier or later, and the possible start of fuel injection is subsequently changed. In accordance with the invention, by means of the rotation of the cam ring, it now has at its outer circumference a connecting member 12 that is shaped like a roller that has been placed in one piece onto the cylindrical outside surface of the cam ring. Because of the one-piece design, the connecting member 12 is only roller-shaped over part of its outer circumference.

This roller-shaped connecting member engages a recess 14 in an adjusting member 16 of an adjusting device 17 in order to adjust the cam ring. This is a hydraulic injection adjuster, which is standard for distributor fuel injection pumps and comprises a piston, the said adjusting member 16, which is displaceably disposed in a cylinder 18, wherein its one face end is engaged by a restoring spring 19 and its other face end is engaged by a hydraulic adjusting pressure 20 that is constantly supplied via a line 21 from a pressure source 22, which is not shown in more detail. Corresponding to the adjusting pressure, the piston 60 is displaced more or less counter to the force of the restoring spring 19 and, in this way, sets the rotating position of the cam ring and thus the start of injection. This adjusting device is intended in particular to keep the cam ring in the first set position, counter to the restoring forces caused by the running of the rollers 6 on the cams 11 during the pressure stroke of the pump piston.

FIG. 2 shows the top view of a partial section along line II—II of FIG. 1. The section extends through the axis of the roller-shaped connecting member and shows that this member is embodied ball-like in its outer contour in its lengthwise extension. This can compensate for misalignments between the adjusting member 16 and the cam ring. For better seating of the roller-shaped end of the connecting member 12 in the adjusting member 16, a bearing element 24 is inserted into the recess that encloses the connecting member over an area larger than 180°. The adjusting member can move easily in the bearing block 25 formed in this way, and an optimum force transfer occurs from the adjusting member to the cam ring.

In a simplified embodiment of a second exemplary embodiment in accordance with FIG. 3, the connecting member 12 is provided, only on the sides of its lengthwise extension parallel to the axis of the cam ring, with a roller-shaped surface that points in the direction of the adjusting motion of the adjusting member 16. In this case the connecting member 12 is in direct contact with the recess 14 of the adjusting member 16. In an alternative embodiment, the connecting member can, of course, also be additionally processed and have an end that is ball-end-like, with which it engages a correspondingly formed recess analogous to the recess 14 in the adjusting member.

The concept of the invention was described in the above example for a radial piston pump. Identical or similar conditions are also present in another distributor pump design, however, in which the cam drive comprises a cam disk having an axially pointing cam surface and a roller ring, on whose rollers the cam surface runs. This distributor fuel injection pump is also provided with a rotatingly driven element, in this case the cam disk, and an essentially stationary element, in this case the cam ring. This is also brought into an appropriate, desired rotating position through an injection adjuster, analogously to the above-described example. A connecting member and adjustment member are necessary for this roller ring. In this pump this connecting member can be embodied and disposed analogously to the above-described exemplary embodiment.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising an essentially stationary, rotatable, adjustable, annular element (8), said adjustable annular element (8) has a cylindrical circular jacket face by means of which said adjustable annular element is guided in a cylindrical circular recess of said fuel injection pump, said adjustable annular element (8), includes an integral radially protruding connecting member (12) that protrudes outwardly of a circumference and engages a recess (14) of an adjusting member (16) for rotatably adjusting said annular member, said radially protruding connecting member and said rotatable annular element (8) are formed from a single piece of material, said rotatable annular element includes a cam race (7) disposed on an inner surface face of said adjustable annular element that forms a cam course on said inner surface face of said adjustable annular element, a rotatingly driven element (1) is disposed coaxially within said rotatable annular element, said rotatingly driven element including at least one radially extending reciprocatable pump piston (3), a roller (6) is operatively connected onto one end of each of said at least one pump piston relative to said cam race (7), each said roller transfers a force onto each said at least one piston due to the cam course to produce a reciprocating piston movement that follows the cam race, fuel being pumped by the reciprocating action of said at least one piston, and said adjustable annular element is adjusted by engagement of said radially protruding connecting member engaging said recess in said adjusting member (16) via movement of said adjusting member (16).

2. The fuel injection pump as defined by claim 1, in which at least the part of the adjusting member oriented toward the adjustment direction of the adjusting member (16) is roller-shaped in a region of its engagement with the recess (14), and has an axis parallel to the axis of rotation of the annular element (8).

3. The fuel injection pump as defined by claim 2, in which the adjusting member is roller-shaped and crowned along its axis.

4. The fuel injection pump as defined by claim 1, in which said recess (14) in said adjusting member includes a bearing element (24) that receives the connecting member (12) in a bearing block (25).

5. The fuel injection pump as defined by claim 2, in which said recess (14) in said adjusting member includes a bearing element (24) that receives the connecting member (12) in a bearing block (25).

6. The fuel injection pump as defined by claim 3, in which said recess (14) in said adjusting member includes a bearing element (24) that receives the connecting member (12) in a bearing block (25).

* * * * *